US006552693B1

(12) United States Patent
Leisten

(10) Patent No.: US 6,552,693 B1
(45) Date of Patent: Apr. 22, 2003

(54) ANTENNA

(75) Inventor: Oliver Paul Leisten, Northampton (GB)

(73) Assignee: Sarantel Limited, Wellingborough (GB)

( * ) Notice: Subject to any disclaimer, the term of this patent is extended or adjusted under 35 U.S.C. 154(b) by 0 days.

(21) Appl. No.: 09/450,850

(22) Filed: Nov. 29, 1999

(30) Foreign Application Priority Data

Dec. 29, 1998 (GB) ..... 9828768

(51) Int. Cl.[7] ..... H01Q 1/36

(52) U.S. Cl. ..... 343/895; 343/702; 343/821; 343/859

(58) Field of Search ..... 343/702, 821, 343/859, 895, 850, 853

(56) References Cited

U.S. PATENT DOCUMENTS

| | | | |
|---|---|---|---|
| 2,575,377 A | 11/1951 | Wohl | 250/33 |
| 2,763,003 A | 9/1956 | Harris | 343/895 |

(List continued on next page.)

FOREIGN PATENT DOCUMENTS

| | | |
|---|---|---|
| DE | 3217437 A1 | 11/1983 |
| EP | 0 051 018 B1 | 7/1985 |
| EP | 0 198 578 A1 | 10/1986 |
| EP | 0 241 921 A1 | 10/1987 |
| EP | 0 320 404 B1 | 6/1989 |
| EP | 0 332 139 A3 | 9/1989 |
| EP | 0 429 255 A2 | 5/1991 |
| EP | 0 465 658 A1 | 1/1992 |
| EP | 0 469 741 A1 | 2/1992 |
| EP | 0 521 511 A2 | 1/1993 |
| EP | 0 588 271 A1 | 3/1994 |
| EP | 0 588 465 A1 | 3/1994 |
| EP | 0 590 534 A1 | 4/1994 |
| EP | 0 652 645 A1 | 5/1995 |
| EP | 0 777 293 A1 | 6/1997 |
| EP | 0 791 978 A2 | 8/1997 |
| FR | 2570546 A1 | 3/1986 |

(List continued on next page.)

OTHER PUBLICATIONS

Nakano, H., "Helical and Spiral Antennas—A Numerical Approach", *Research Studies Press Ltd.*, England, pp. 1–261 (1987).

Krall et al., *IEEE Transactions on Antennas and Propagation*, vol. AP–27, No. 6, Nov. 1979, pp. 850–853.

Casey, J. et al., "Square Helical Antenna with a Dielectric Core", *IEEE Transactions on Electromagnetic Compatibility*, vol. 30, No. 4, Nov. 1988, pp. 429–436.

Espaignol, J. et al., "Duplexeur A Resonateurs Dielectriques En Bande K", *6es Journees Nationales Microondes*, Montpellier, Jun. 21–23, 1989, Centre D'Electronique De Montpellier, pp. 321–322.

*Primary Examiner*—Don Wong
*Assistant Examiner*—Shih-Chao Chen
(74) *Attorney, Agent, or Firm*—Gray Cary Ware & Freidenrich, LLP

(57) ABSTRACT

A dielectric-loaded antenna for circularly polarized radiation has a generally cylindrical solid dielectric body with a relative dielectric constant greater than 5, upon which body is plated a conductive sleeve encircling the body and a conductive end layer which, together with the body, form an open-ended cavity substantially filled with the ceramic material of the body. The electrical length of the cavity rim is a whole number of guide wavelengths corresponding to the antenna operating frequency less than 5 GHz. A rotating standing wave is excited around the cavity rim by a feeder structure including two helical conductor tracks on the cylindrical surface of the body which are coupled between the cavity rim and a coaxial feeder passing axially through the body.

36 Claims, 4 Drawing Sheets

U.S. PATENT DOCUMENTS

| | | | | |
|---|---|---|---|---|
| 3,611,198 | A | 10/1971 | Ma | 333/6 |
| 3,633,210 | A | 1/1972 | Westerman | 343/895 |
| 3,906,509 | A | 9/1975 | DuHamel | 343/895 |
| 3,940,772 | A | 2/1976 | Ben-dov | 343/853 |
| 4,008,478 | A | 2/1977 | Ikarath et al. | 343/720 |
| 4,008,479 | A | 2/1977 | Smith | 343/895 |
| 4,114,164 | A | 9/1978 | Greiser | 343/895 |
| 4,148,030 | A | 4/1979 | Foldes | 343/895 |
| 4,160,979 | A | 7/1979 | Drewett | 343/788 |
| 4,168,479 | A | 9/1979 | Rubin | 333/126 |
| 4,204,212 | A | 5/1980 | Sindoris et al. | 343/700 MS |
| 4,270,128 | A | 5/1981 | Drewett | 343/702 |
| 4,323,900 | A | 4/1982 | Krall et al. | 343/700 MS |
| 4,329,689 | A | 5/1982 | Yee | 343/700 MS |
| 4,349,824 | A | 9/1982 | Harris | 343/700 MS |
| 4,442,438 | A | 4/1984 | Siwiak et al. | 343/792 |
| 4,608,572 | A | 8/1986 | Blakney et al. | 343/792.5 |
| 4,608,574 | A | 8/1986 | Webster et al. | 343/895 |
| 4,697,192 | A | 9/1987 | Hofer et al. | 343/895 |
| 4,706,049 | A | 11/1987 | Dydyk | 333/110 |
| 4,862,184 | A | 8/1989 | Ploussios | 343/745 |
| 4,902,992 | A | 2/1990 | Rubin et al. | 333/126 |
| 4,910,481 | A | 3/1990 | Sasaki et al. | 333/134 |
| 4,940,992 | A | 7/1990 | Nguyen et al. | 343/803 |
| 4,980,694 | A | 12/1990 | Hines | 343/702 |
| 5,019,829 | A | 5/1991 | Heckman et al. | 343/700 MS |
| 5,023,866 | A | 6/1991 | De Muro | 370/24 |
| 5,055,852 | A | 10/1991 | Dusseux et al. | 343/725 |
| 5,081,469 | A | 1/1992 | Bones | 343/895 |
| 5,099,249 | A | 3/1992 | Seavey | 343/700 MS |
| 5,134,422 | A | 7/1992 | Auriol | 343/895 |
| 5,170,176 | A | 12/1992 | Yasunaga et al. | 343/895 |
| 5,170,493 | A | 12/1992 | Roth | 455/82 |
| 5,255,005 | A | 10/1993 | Terret et al. | 343/895 |
| 5,258,728 | A | 11/1993 | Taniyoshi et al. | 333/132 |
| 5,281,934 | A | 1/1994 | Shiau et al. | 333/134 |
| 5,298,910 | A | 3/1994 | Takei et al. | 343/895 |
| 5,329,287 | A | 7/1994 | Strickland | 343/752 |
| 5,341,149 | A | 8/1994 | Valimaa et al. | 343/895 |
| 5,345,248 | A | 9/1994 | Hwang et al. | 343/895 |
| 5,346,300 | A | 9/1994 | Yamamoto et al. | 343/895 |
| 5,349,361 | A | 9/1994 | Egashira et al. | 343/715 |
| 5,349,365 | A | 9/1994 | Ow et al. | 343/895 |
| 5,406,296 | A | 4/1995 | Egashira et al. | 343/715 |
| 5,406,693 | A | 4/1995 | Egashira et al. | 29/600 |
| 5,450,093 | A | 9/1995 | Kim | 343/895 |
| 5,479,180 | A | 12/1995 | Lenzing et al. | 343/729 |
| 5,541,613 | A | 7/1996 | Lam et al. | 343/792.5 |
| 5,548,255 | A | 8/1996 | Spielman | 333/132 |
| 5,612,707 | A | 3/1997 | Vaughan et al. | 343/895 |
| 5,661,494 | A * | 8/1997 | Bondyopadhyay | 343/700 MS |
| 5,748,154 | A | 5/1998 | Yokota | 343/702 |
| 5,854,608 | A | 12/1998 | Leisten | 343/895 |
| 5,859,621 | A | 1/1999 | Leisten | 343/895 |
| 5,945,963 | A | 8/1999 | Leisten | 343/895 |
| 5,963,180 | A | 10/1999 | Leisten | 343/895 |

FOREIGN PATENT DOCUMENTS

| | | |
|---|---|---|
| FR | 2603743 | 3/1988 |
| GB | 762415 | 11/1956 |
| GB | 840850 | 7/1960 |
| GB | 1198410 | 7/1970 |
| GB | 1568436 | 5/1980 |
| GB | 2196483 B | 4/1988 |
| GB | 2 202 380 A | 9/1988 |
| GB | 2 243 724 B | 11/1991 |
| GB | 2 246 910 A | 2/1992 |
| GB | 2 248 344 B | 4/1992 |
| GB | 2 292 257 A | 2/1996 |
| GB | 2 292 638 A | 2/1996 |
| GB | 2 309 592 A | 7/1997 |
| GB | 2 310 543 A | 8/1997 |
| GB | 2 311 675 A | 10/1997 |
| GB | 2 317 057 A | 3/1998 |
| GB | 2 321 785 A | 8/1998 |
| GB | 2 326 532 A | 12/1998 |
| JP | 3-274904 | 12/1991 |
| JP | 7-249973 | 9/1995 |
| JP | 8-8408 | 1/1996 |
| SU | 1483-511 | 5/1989 |
| WO | WO 91/11038 | 7/1991 |
| WO | WO 92/05602 | 4/1992 |
| WO | WO 92/17915 | 10/1992 |
| WO | WO 93/22804 | 11/1993 |
| WO | WO 94/21001 | 9/1994 |
| WO | WO 94/27338 | 11/1994 |
| WO | WO 96/06468 | 2/1996 |
| WO | WO 97/27642 | 7/1997 |
| WO | WO 98/24144 | 6/1998 |

* cited by examiner

ANTENNA

FIELD OF THE INVENTION

This invention relates to an antenna for operation at frequencies in excess of 200 MHz, and to a radio communication system including the antenna.

BACKGROUND OF THE INVENTION

The applicant has disclosed a family of dielectrically-loaded antennas in a number of co-pending patent applications. Common features of the disclosed antennas include a solid cylindrical ceramic core of high relative dielectric constant, a coaxial feeder passing through the core on its axis to a termination at a distal end, a conductive balun sleeve plated on a proximal portion of the core to create an at least approximately balanced feeder termination at the distal end, and a plurality of elongate helical conductor elements plated on the cylindrical surface of the core and extending between, on the one hand, radial connections with the feeder termination on the distal end face, and, on the other hand, the rim of the sleeve.

In one of the co-pending applications, GB-A-2292638, there is disclosed a quadrifilar backfire antenna having four co-extensive helical elements formed as two pairs, the electrical length of the elements of one pair being different from the electrical lengths of the elements of the other pair. This structure has the effect of creating orthogonally phased currents at an operating frequency of, for example, 1575 MHz with the result that the antenna has a cardioid radiation pattern for circularly polarised signals such as those transmitted by the satellites in the GPS (global positional system) satellite constellation.

In GB-A-2309592, the antenna has a single pair of diametrically opposed helical elements forming a twisted loop yielding a radiation pattern which is ommnidirectional with the exception of a null centred on a null axis extending perpendicularly to the cylinder axis of the antenna. This antenna is particularly suitable for use in a portable telephone, and can be dimensioned to have loop resonances at frequencies respectively within the European GSM band (890 to 960 MHz) and the DCS band (1710 to 1880 MHz), for example. Other relevant bands include the American AMPS (842 to 894 MHz) and PCN (1850 to 1990 MHz) bands.

GB-A-2311675 discloses the use of an antenna having the same general structure as that disclosed in GB-A-2292638 in a dual service system such as a combined GPS and mobile telephone system, the antenna being used for GPS reception when resonant in a quadrifilar (circularly polarised) mode, and for telephone signals when resonant in a single-ended (linearly polarised) mode.

SUMMARY OF THE INVENTION

The applicants have found that, by manipulating the diameter of the conductive sleeve encircling the proximal portion of the core, it is possible to produce a resonance which is characterised by a standing wave around the sleeve rim (referred to herein as a "ring resonance") and which occurs at one of the frequencies used in, for instance, mobile telephones or satellite positioning receivers. The ring resonance is effectively a resonance associated with a circular guide mode or ring mode.

According to a first aspect of the present invention, there is provided an antenna having an operating frequency in excess of 200 MHz, comprising a cylindrical insulative body having a central axis and formed of a solid material which has a relative dielectric constant greater than 5, the outer surface of the body defining a volume the major part of which is occupied by the solid material, a conductive sleeve on the cylindrical surface of the insulative body, a conductive layer on a surface of the body which extends transversely of the axis, the conductive sleeve and layer together forming an open-ended cavity substantially filled with the solid material, and a feeder structure associated with the cavity, wherein the said relative dielectric constant and the dimensions of the cavity are adapted such that the electrical length of its circumference at the open end is substantially equal to a whole number (1, 2, 3, . . . ) of guide wavelengths around the said circumference corresponding to the said operating frequency.

One of the difficulties associated with the known dielectrically loaded quadrifilar backfire antenna referred to above is that the bandwidth of the antenna for circularly polarised signals is relatively narrow. This means that manufacturing tolerances tend to be tight, and the antenna may need to be individually tuned to a required frequency. In an antenna in accordance with the present invention it is possible to arrange for the feeder structure to excite a rotary standing wave around the rim of the cavity at its open end, so as to produce an antenna which is resonant for circularly polarised waves and which has an associated cardioid radiation pattern suitable for receiving signals from satellites when used with its axis vertical. The applicants have found that the bandwidth associated with such a resonance is much wider than the bandwidth of the quadrifilar antenna.

It should be noted that the term "excite" is used in this context as a reference to not only use of the antenna for transmitting signals, but also use of the antenna for receiving signals, since the functional characteristics of the antenna such as its frequency response, radiation pattern, etc. obey the reciprocity rule with respect to corresponding transmitting and receiving characteristics. Similarly, references to elements or parts which "radiate" when used in the context of an antenna for receiving signals should be construed to include elements or parts which absorb energy from the surrounding space but which, by virtue of the reciprocity rule, would radiate if the antenna were to be used for transmission.

One way of exciting circular standing waves in the sleeve is to employ elongate helical or spiral elements on the surface of the insulative body. In effect, the helical elements impart a tangential component of excitation at the sleeve or sleeve rim so that they may be regarded as tangential excitation or feed means. With appropriate choice of dielectric constant and dimensioning of the sleeve and the helical or spiral elements, the antenna can be made to operate as a dual-mode antenna, with a circular polarisation mode associated with the ring resonance, i.e. a standing wave around the rim of the cavity, and a linear mode associated with the loop resonance referred to above in connection with the twisted loop configuration.

Preferably, at the frequency of the ring mode resonance, the helical elements each have an electrical length equal to $n\lambda_g/4$ wherein n is a whole number (1, 2, 3, . . . ) and $\lambda_g$ is the guide wavelength along the elements at the frequency of the ring resonance.

In this connection, it will be appreciated by those skilled in the art that "guide wavelength" means the distance represented by a complete wave cycle at the frequency in question along the path used for measurement, i.e. the path along which the wave is guided. In the present case, the measurement path is the respective helical element or the sleeve rim, and the guide wavelength is less than the corresponding wavelength in space by a factor which is governed by the dielectric constant of the core material and by the geometry of the antenna structure. It is to be understood that, with the dielectric constant of the core material being substantially greater than that of free space, the guide wavelength $\lambda_g$ around the rim of the sleeve or along the helical elements is much less than the wavelength in free space, but generally not the same in each case. In the case of the rim, the current path is very strongly affected by the dielectric material because the associated fields are largely within the material, whereas the current paths of the helical elements are less strongly affected, being at the boundary between dielectric material and air.

It is possible, then, to produce a multiple-mode antenna suitable particularly, but not exclusively, for circularly polarised signals without using the narrow band quadrifilar structure referred to above. Consequently, a preferred use of the antenna is for portable or mobile equipment such as multiple-band portable or mobile telephones, particularly cellular telephones, or, more particularly, portable or mobile telephones for the Globalstar and Iridium satellite telephone systems, as well as portable telephones or other units having a GPS or GLONASS positioning function, these satellite services being services which employ circularly polarised signals.

According to a second aspect of the invention, there is provided a radio signal receiving and/or transmitting system comprising a radio frequency front end stage constructed to operate at a first signal receiving or transmitting frequency and, coupled to the front end stage, an antenna which comprises: a cylindrical insulative body having a central axis and formed of a solid material with a dielectric constant greater than 5, the outer surface of the body defining a volume the major part of which is occupied by the solid material, a conductive layer on a surface of the body which extends transversely of the axis, the conductive sleeve and layer together forming an open-ended cavity substantially filled with the solid material, and a feeder structure associated with the cavity, wherein the said relative dielectric constant and the dimensions of the cavity are adapted such that the electrical length of the rim of the cavity at its open ends is substantially equal to a whole number (1, 2, 3, . . . ) of guide wavelengths corresponding to the first signal frequency.

The invention also includes, according to a third aspect, a dielectrically-loaded cavity-backed antenna for circularly polarised waves at a required operating frequency in excess of 200 MHz, comprising a cavity with a conductive cylindrical side wall and a conductive bottom wall joined to the side wall, the side wall having a rim defining a cavity opening opposite the bottom wall, a dielectric core substantially filling the cavity and formed of a solid material having a relative dielectric constant greater than 5, and a rotational feed system, characterised in that the said dielectric constant and the dimensions of the cavity are such that the circumference of the rim is substantially equal to a whole number (1, 2, 3, . . . ) of guide wavelengths at the required operating frequency, and wherein the feed system is adapted to excite a waveguide resonance at the rim of the cavity at the required operating frequency, which resonance is characterised by at least one voltage dipole oriented diametrically across the cavity opening and spinning about the central axis of the cavity thereby to produce a circular polarisation radiation pattern which is directed axially outwardly from the opening of the cavity and has a null in the opposite axial direction.

Further preferred features of the antenna and system are set out in the dependent claims appearing at the end of this specification.

The invention will be described below by way of example with reference to the drawings.

DETAILED DESCRIPTION OF THE PREFERRED EMBODIMENTS

Figure 1:
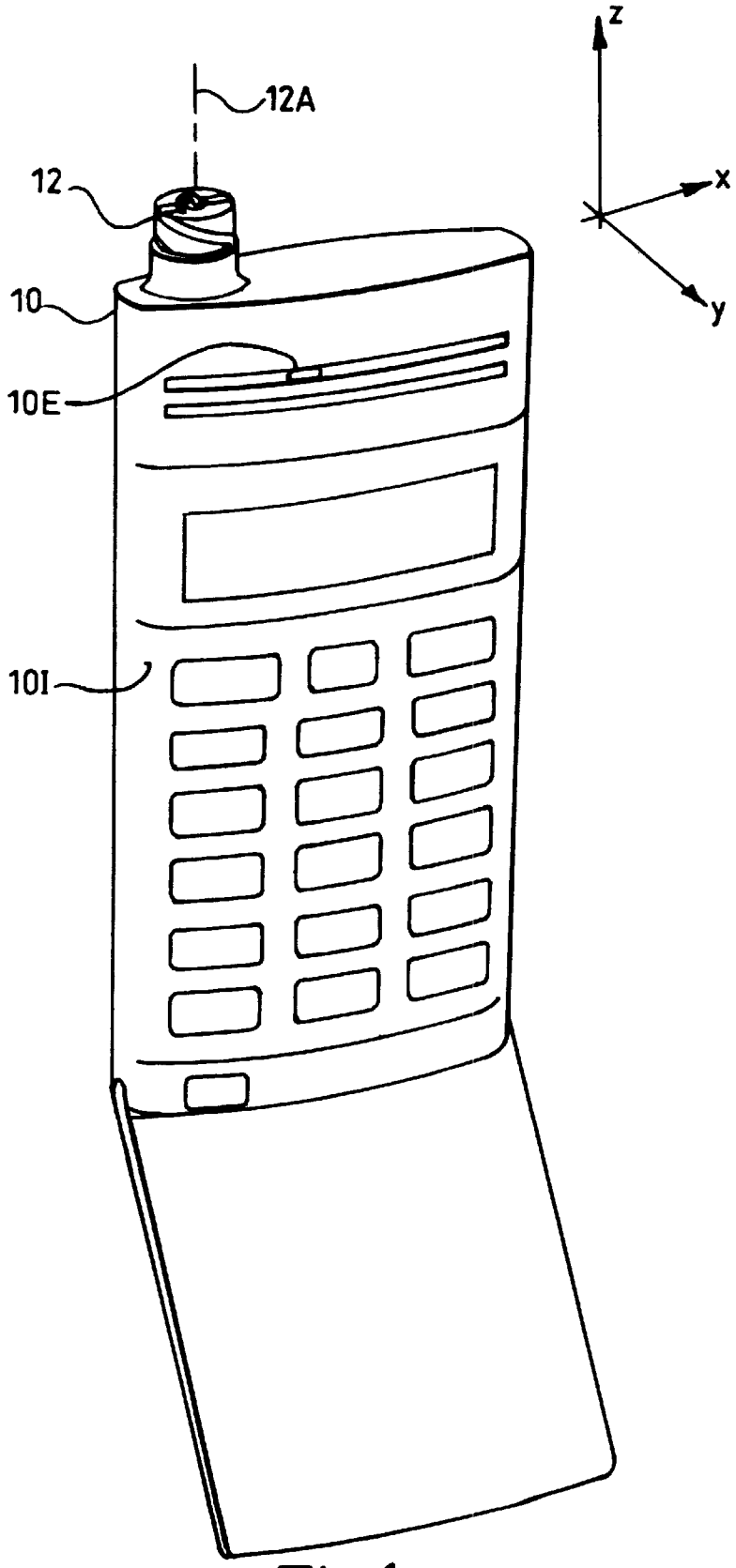
FIG. 1 is a perspective view of a portable telephone including an antenna in accordance with the invention.

Referring to FIG. 1, a handheld communication unit, in this case, a portable telephone has a telephone body 10 with an inner face 101, at least part of which is normally placed against the head of the user when used to make a call, so that the earphone 10E is adjacent the user's ear. The telephone 10 has an antenna 12 mounted at the end of the telephone body 10 with its central axis 12A running longitudinally of the body 10 as shown.

Figure 2:
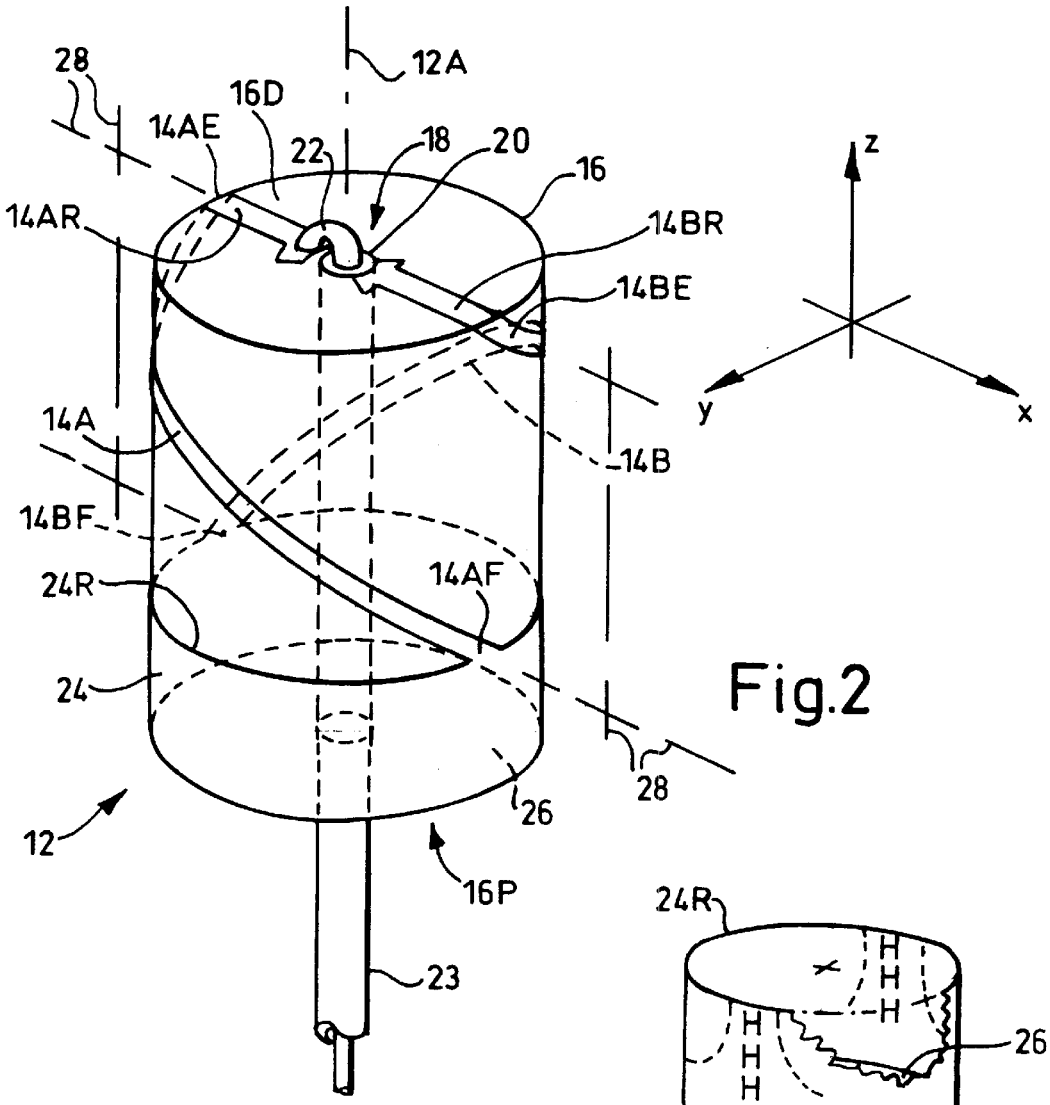
FIG. 2 is a perspective view of the antenna appearing in FIG. 1.

The antenna 12 is shown in more detail in FIG. 2. As will be seen, the antenna has two longitudinally extending elements 14A, 14B formed as metallic conductor tracks on the cylindrical outer surface of a ceramic core 16. The core 16 has an axial passage 18 with an inner metallic lining 20, and the passage houses an axial inner feed conductor 22. The inner conductor 22 and the lining 20 in this case form a coaxial transmission line through the core for coupling a feed line 23 to the antenna elements 14A, 14B at a feed position on the distal end face 16D of the core. The conductors on the core also include corresponding connecting radial antenna elements 14AR, 14BR formed as metallic tracks on the distal end face 16D, connecting diametrically opposed .ends 14AE, 14BE of the respective longitudinally extending elements 14A, 14B to the feed line. The junction of these radial elements and the axial transmission line constitutes a balanced feed termination. The other ends 14AF, 14BF of the antenna elements 14A, 14B are also diametrically opposed and are linked by a cylindrical conductor 24 in the form of a plated sleeve surrounding a proximal end portion of the core 16. This sleeve is, in turn, connected to the lining 22 of the axial passage 18 by a transversely extending conductive layer 26 on the proximal end face 16P of the core 16. The sleeve 24 and the conductive layer 26 together form a open-ended cavity filled with the dielectric material of the core, the open end of the cavity being defined by a rim 24R lying substantially in a plane perpendicular to the central axis 12A of the core and the antenna as a whole.

Accordingly, the sleeve 24 covers a proximal portion of the antenna core 16, thereby surrounding the coaxial transmission line formed by the lining 20 and the inner conductor 22, the material of the core 16 filing the whole of the space between the sleeve 24 and the lining 20. As described in the above-mentioned co-pending applications, the sleeve 24 and the transverse layer 26 together form a balun so that signals in the feed line are converted between an unbalanced state at the proximal end of the antenna to an at least approximately balanced state at the distal face 16D.

A further effect of the sleeve 24 is that the rim 24R of the sleeve 24 can effectively constitute an annular current path isolated from the ground represented by the outer conductor of the feed line which means that, in this isolating condition, currents circulating in the elongate helical elements 14A, 14B are confined to the rim 24R so that these elements, the rim, and the radial elements 14AR, 14BR together form an isolated loop.

Figure 3:
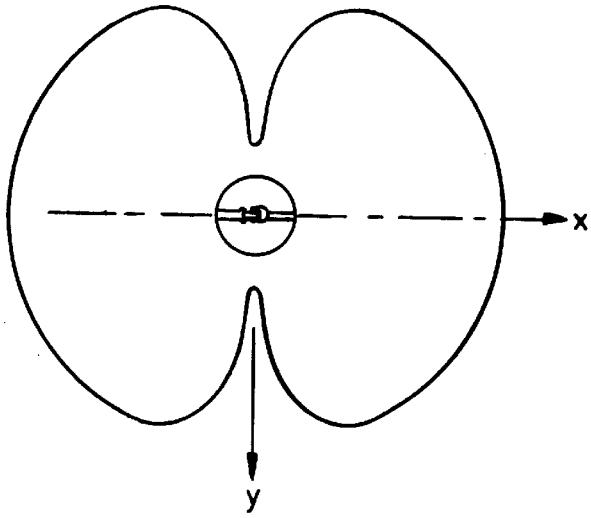
FIG. 3 is a diagram illustrating the horizontal polarisation radiation pattern produced when the antenna is resonant in a loop mode.

In the illustrated antenna, the longitudinally extending helical elements 14A, 14B are of equal length, each being in the form of simple helix executing a half turn around the axis 12A of the core 16 with the distal and proximal ends of the helical elements respectively located in a common plane, as indicated by the chain lines 28 in FIG. 2. The balanced termination of the transmission line also, clearly, lies in this plane. An effect of this structure is that when the antenna is resonant in a loop mode it has a null in its radiation pattern in a direction transverse to the axis 12A and perpendicular to the plane 28. This radiation pattern is, therefore, approximally of a figure-of-8 shape in both the horizontal and vertical planes transverse to the axis 12A, as shown by FIG. 3. Orientation of the radiation pattern with respect to the antenna as shown in FIG. 2 is shown by the axis system comprising axes x, y, z shown in FIGS. 1, 2 and 3. The radiation pattern has two notches, one on each side of the antenna. To orient one of the nulls of the radiation pattern in the direction of the user's head, the antenna is mounted such that its central axis 12A and the plane 28 are parallel to the inner face 10I of the handset 10, as shown in FIG. 1. The relative orientations of the antenna, its radiation pattern, and the telephone body 10 are evident by comparing the axis system x, y, z as it is shown in FIG. 2 with the representations of the axis system appearing in FIGS. 1 and 3.

Figure 4B:
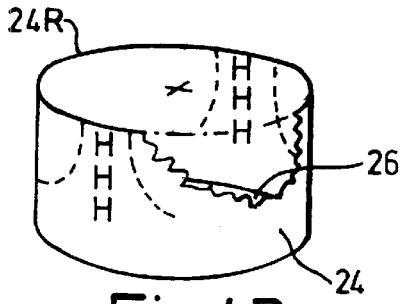
FIGS. 4A and 4B are diagrams illustrating a ring mode resonance in the sleeve forming part of the antenna of FIG. 2.
Figure 4A:
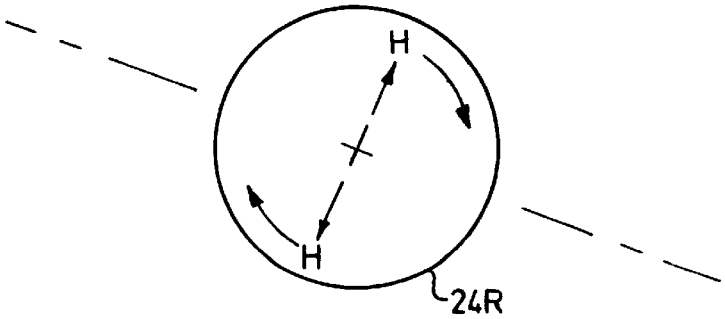

The antenna shown in FIG. 2 also has resonances due to the sleeve acting as a waveguide. In particular, if the circumference of the sleeve is equal to an integer number of guide wavelengths at a required alternative operating frequency, a ring mode resonance is set up, characterised by at least one voltage dipole oriented diametrically across the cavity opening. The helical elements 14A, 14B which, together with the radial connections 14AR, 14BR and the transmission line 20, 22, act as a feed system, impart a rotational component to the dipole such that it spins about the central axis 12A. This effect is shown diagrammatically in the plan view of FIG. 4, in which the dipole is illustrated as extending between two diametrically opposed locations "H" of high voltage amplitude, the arrows indicating the rotational component. Computer simulations of the antenna structure (produced using the microstripes package of Kimberley Communications Consultants Ltd.) reveal that the ring resonance is characterised by current density maxima at diametrically opposed positions "H" not only at the rim 24R of the sleeve but also extending down the inner surface of the sleeve towards the transverse conductive layer or bottom wall 26, as shown in FIG. 4B. The dotted lines in FIG. 4B indicate approximate contours of constant current density on the inner surface of the sleeve. The patterns shown in FIGS. 4A and 4B correspond to a ring resonance occurring when the circumference of the rim 24R is substantially equal to the wavelengths $\lambda_g$ at the required alternative operating frequency. Further ring resonances exist when the guide wavelength is an integer sub-multiple of the rim circumference so that, for instance, two or three opposed pairs of current and voltage maxima are present, spaced around the rim 24R and the inner surface of the sleeve 24. Thus, in the general case, one or more pairs diametrically opposed current maxima like the pair shown in FIG. 4B may exist at the operating frequency or frequencies.

Figure 5:
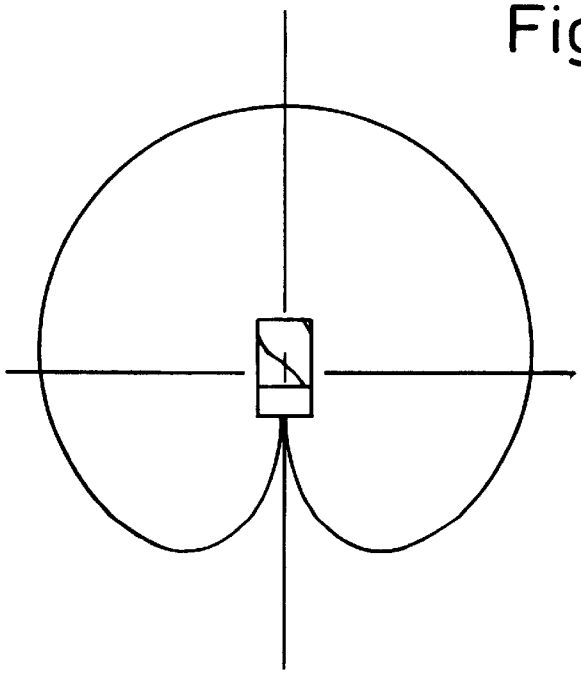
FIG. 5 is a diagram illustrating the circular polarisation radiation pattern produced when the antenna is resonant in the ring mode.

In each case, the ring resonance yields a cardioid radiation pattern for circularly polarised radiation at the respective frequencies, as shown in FIG. 5. It follows that the antenna is particularly suitable for receiving circularly polarised signals when the antenna is oriented with the open end of the cavity pointing upwards. In this way, satellites in view fall within the upper dome of the cardioid response, substantially irrespective of bearing.

The applicants have, therefore, made use of the sleeve 24, which is used as a balun, also to form a waveguide which is excited in a circular guide mode of resonance. This is achieved without orthogonal phasing antenna element structures such as in the prior quadrifilar antenna disclosed in GB-A-2292638, such a structure being characterised by two orthogonally related pairs of diametrically opposed helical elements arranged such that the elements of one pair form part of a conductive path which is longer than the path containing the elements of the other pair.

The spinning dipole referred to above is achieved by virtue of the tangential excitation component imparted by the rim being connected to helical elements of the feed system at diametrically opposite positions. Advantageously, each series combination of helical element 14A, 14B and connection element 14AR, 14BR has an electrical length equal to a whole number of guide quarter-wavelengths. The preferred embodiment, as illustrated in FIG. 2, has helical and radial element combinations each having an electrical length which is one half of the guide wavelength along those elements, so that current maximum at the balanced feed termination on the distal face 16D is translated to current maxima at the junctions 14AF, 14BF of the helical elements 14A, 14B with the rim 24R. Balance at the termination on the distal end face 16D is achieved by virtue of the sleeve 24 acting as a balun at the frequency of ring resonance.

The antenna described above with reference to FIG. 2 is configured and dimensioned to exhibit a ring resonance in the Globalstar uplink (user to satellite) transmit band of 1610 to 1626.5 MHz and a loop resonance in the European GSM cellular telephone band of 890 to 960 MHz. The first of these bands is also the uplink band for the Iridium satellite telephone system. In this first band, the electrical length of the sleeve rim 24R is at least approximately equal to the guide wavelength $\lambda_g$ (i.e. each semicircle between the junctions of the helical elements 14A, 14B and the rim 24R yields a phase shift of about 180° at a frequency within the band. Each helical element 14A, 14B and its associated radial connection element 14AR, 14BR have an electrical length $\lambda_g/2$. Although each helical and radial element combination is considerably longer than the rim semicircle beneath, it has a similar electrical length because the effective value for the relative dielectric constant experienced by the two current paths is different such that $\lambda_g$ along the rim is shorter than $\lambda_g$ along the helical and radial elements at the same frequency.

The loop resonance, in this embodiment in the GSM band, occurs when the looped conductive path represented by the radial and helical elements 14AR, 14A, one or other of the semicircles of the rim 24R, and the other helical and radial elements 14B, 14BR, has an electrical length of one wavelength (i.e. a phase transition of 360°).

Typically, these resonances are seen when the relative dielectric constant $\in_r$ of the ceramic core 16 is 90, the diameter of the core 16 is 10 mm, the axial extent of the balun sleeve 24 is 4 mm, and the axial length of the helical elements 14A, 14B (i.e. parallel to the axis 12A) is about 14.85 mm. In other respects, the antenna structure is as described in the above prior published patent applications, the disclosure is which is incorporated in this specification by reference. The particular material used for the core 16 in the preferred embodiment in the present application is barium titanate or barium-neobidium titanate.

Alternative antennas giving different combinations of resonances to suit different services can be designed by, for instance, first establishing suitable dimensions for the twisted loop as described in the above-mentioned GB-A-2309592 to suit one of the required operating frequencies, and then manipulating the diameter of the sleeve to produce the required whole number of guide wavelengths to suit the other of the required operating frequencies. The above-mentioned simulation package can be used to view current and field densities in a software model of the antenna or parts of the antenna. The ring resonance has particular recognisable characteristics as described above with reference to FIG. 4B. A variety of frequency combinations are available not only by choosing different dielectric constants and dimensions, but also by allowing the electrical lengths of the rim, the helical elements and their radial connections and the depth of the balun to be equivalent to integral multiples of the guide wavelengths or quarter guide wavelengths as appropriate. The depth of the balun together with the radius of the transverse conductive layer or bottom wall of the cavity are typically in the region of $\lambda_g/4$ to achieve balance at the distal face 16D of the core. Odd number multiples of $\lambda_g$ or $\lambda_g/4$ may be used instead.

In addition, the ring resonance may be combined with other resonances of the structure described in the above-mentioned prior published applications, including a quasi-monopole resonance characterised by a single-ended mode in which the radial connections 14AR, 14 BR, the helical elements 14A, 14B, and the sleeve 24 combine to form linear paths from the feed termination of the distal face 16D through to the junction of the transverse conductive layer 26 with the outer screen 20 of the transmission line.

Figure 7:
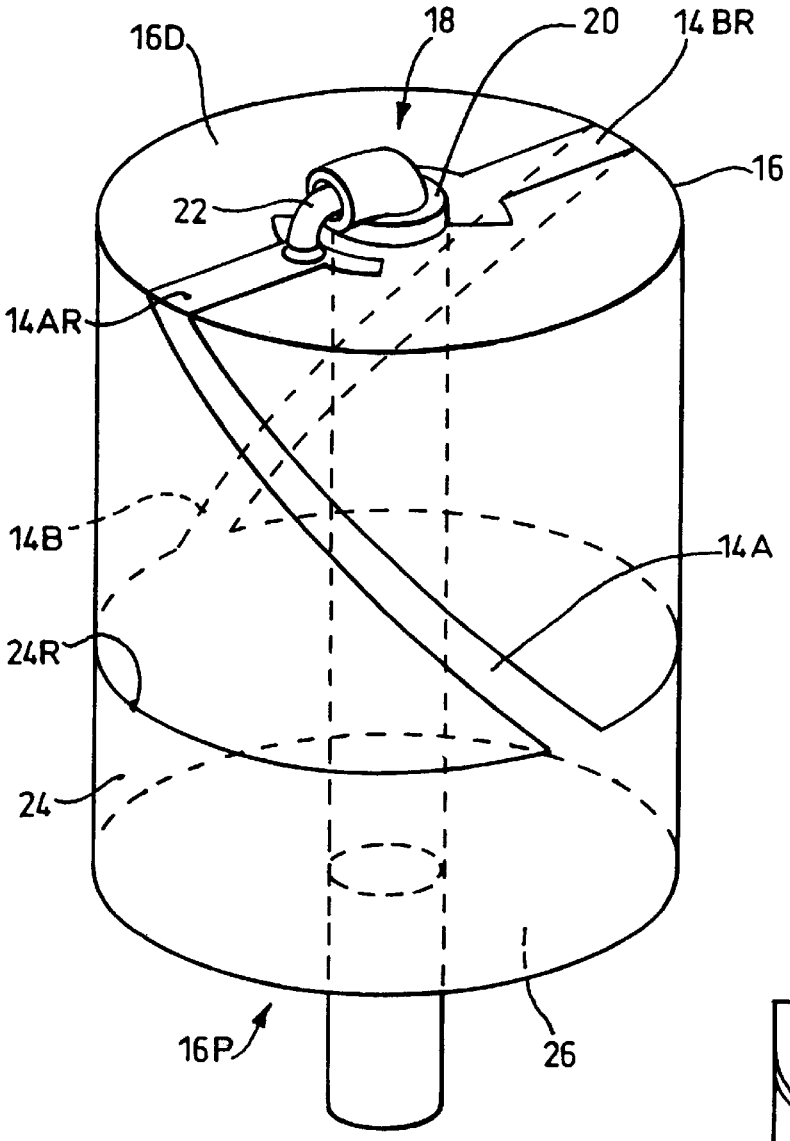
FIG. 7 is a diagram showing a coupler for the telephone shown in FIGS. 1 and 6.

In other embodiments of the invention, the ring resonance may be used by itself. An alternative structure which dispenses with the loop mode of resonance is illustrated in FIG. 7. In this case, each helical element 14A, 14B is a quarter-turn element (as opposed to a half-turn element in the embodiment of FIG. 2), the electrical length of each helical element and its associated radial connection 14AR, 14BR being generally equal to $\lambda_g/4$, yielding a complete 360° electrical loop at the frequency of ring resonance (each semicircle of the rim 24R having an electrical length of $\lambda_g/2$).

Figure 6:
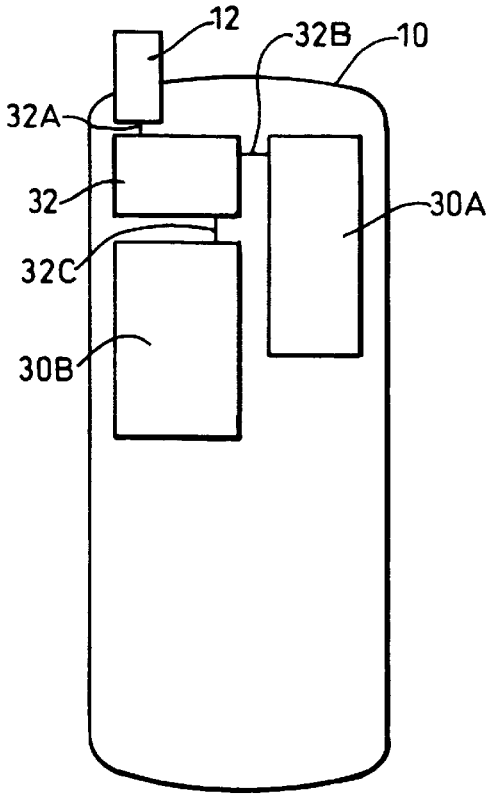
FIG. 6 is a block diagram of the telephone in FIG. 1.
Figure 8:
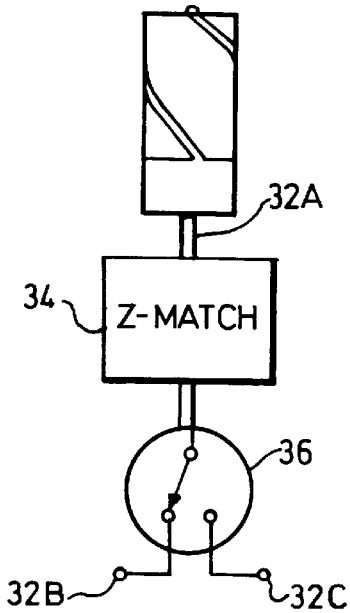
FIG. 8 is a perspective view of a second antenna in accordance with the invention.

In multiple-band embodiments of the antenna, signals may pass between the antenna and the respective portions of a radio frequency (RF) front end stage of the connected radio communication equipment via a coupling stage as shown in FIG. 6. The equipment may be a handheld telephone unit 10 having an antenna 12 as described above with reference to FIG. 2, and RF front end stage portions 30A, 30B forming separate RF channels constructed to receive and/or transmit signals in respective operating frequency bands. These front end portions 30A, 30B are connected to the antenna 12 by a coupling stage 32 having a common signal line 32A for the antenna feed line and two signal lines 32B, 32C for the respective front end portions 30A, 30B. The above-mentioned prior-published GB-A-2311675 discloses a coupling stage in the form of a diplexer, the principle of which may be used where simultaneous use of the antenna 12 in different frequency bands is required. Alternatively, referring to FIG. 8, the simple combination of an impedance matching section 34 and a two-way RF switch 36 (typically a p.i.n. diode device) may be used. Depending of the state of the switch 36, the common line 32A is coupled to one or other of the two further signals lines or ports 32B, 32C, to which the different front end portions may be connected. It will be appreciated by those skilled in the art that the antenna 12 may be used with communication equipment which is split between separate physical units rather than in a single unit 10 as shown in FIG. 6.

What is claimed is:

1. An antenna having an operating frequency in excess of 200 MHz comprising a cylindrical insulative body having a central axis and formed of a solid material which has a relative dielectric constant greater than 5, the outer surface of the body defining a volume the major part of which is occupied by the solid material, a conductive sleeve on the cylindrical surface of the insulative body, a conductive layer on a surface of the body which extends transversely of the axis, the conductive sleeve and layer together forming an open-ended cavity substantially filled with the solid material, and a feeder structure associated with the cavity, wherein the relative dielectric constant and the dimensions of the cavity are adapted such that the electrical length of its circumference at the open end is substantially equal to a whole number (1, 2, 3, . . . ) of guide wavelengths around the circumference corresponding to the operating frequency, wherein the antenna has a radiation pattern for circularly polarised radiation at the operating frequency, which pattern is cardioid-shaped with its maximum along the axis of the insulative body outwardly away from the open end of the cavity.

2. The antenna according to claim 1, wherein the operating frequency is less than 5 GHz.

3. The antenna according to claim 1, wherein the feeder structure is arranged to excite a rotating standing wave around the rim of the cavity at its open end.

4. The antenna according to claim 3, wherein the feeder structure comprises elongate helical elements on the cylindrical surface of the insulative body.

5. The antenna according to claim 4, wherein the feeder structure further comprises a balanced feed termination, and has two said helical elements which are axially coextensive, diametrically opposed, and each extend from a respective connection with the feed termination to the rim of the cavity, and wherein the electrical length of each of the helical elements and any element forming its respective connection with the feed termination is equal to $n\lambda_g/4$ where n is a whole number (1, 2, 3, . . . ) and $\lambda_g$ is the guide wavelength along the elements at the operating frequency.

6. The antenna according to claim 1, wherein the feeder structure comprises a balanced feed termination and a pair of conductive tracks running from the feed termination and along opposite sides of the insulative body to diametrically opposed locations on the rim of the cavity at its open end, and wherein the electrical length of each of the tracks is equal to $n\lambda_g/4$ where n is a whole number (1, 2, 3, . . . ) and $\lambda_g$ is the guide wavelength along the tracks at the operating frequency.

7. The antenna according to claim 5, wherein n is equal to 2.

8. The antenna according to claim 1, wherein the feeder structure includes a feeder line extending through the insulative body on the central axis from a connection with the conductive layer to a feed termination beyond the open end of the cavity, and wherein the sleeve is adapted to act as a balun at the operating frequency thereby to convert a single-ended signal on the feeder line adjacent the conductive layer to a balanced signal at the feed termination.

9. The antenna according to claim 1, wherein the relative dielectric constant of the material of the insulative body is in the range of from 50 to 100, preferably about 90.

10. The antenna according to claim 1, adapted such that the operating frequency is substantially 1575 MHz.

11. The antenna according to claim 1, adapted such that the operating frequency is substantially 1228 MHz.

12. The antenna according to claim 1, adapted such that the operating frequency is in the range of from 1597 to 1617 MHz.

13. The antenna according to claim 1, adapted such that the operating frequency is in the range of from 1240 to 1260 MHz.

14. The antenna according to claim 1, adapted such that the operating frequency is in the range of from 1610 to 1626.5 MHz.

15. The antenna according to claim 1, adapted such that the operating frequency is in the range of from 2483.5 to 2500 MHz.

16. The antenna according to claim 1, adapted such that the operating frequency is in the range of from 1626.5 to 1646.5 MHz.

17. The antenna according to claim 1, adapted such that the operating frequency is in the range of from 1525 to 1545 MHz.

18. The antenna according to claim 1, wherein the dielectric core has a portion which extends beyond the cavity opening in the direction of the axis and the feeder structure comprises a pattern of conductors on the surface the core portion.

19. The antenna according to claim 18, wherein the conductors comprise axially coextensive helical elements each connected at one end to a feed termination and at the other end to the side wall rim.

20. The antenna according to claim 19, wherein the feeder structure further comprises a coaxial transmission line extending axially through the bottom wall of the cavity and through the core to the feed termination, the outer screen of the line being connected to the cavity bottom wall, whereby the sleeve acts as a balun promoting balance at the termination.

21. The antenna according to claim 19, wherein the ends of the helical elements lie substantially in a single plane containing the central axis, the antenna exhibiting a loop resonance producing a radiation pattern which is omnidirectional with the exception of a null on a transverse axis passing through the core substantially perpendicularly to the plane.

22. The antenna according to claim 21, wherein the loop resonance occurs at a frequency in the range of from 824 to 960 MHz or the range of from 1710 to 1990 MHz.

23. A radio communication system comprising an antenna according to claim 1 and, coupled to the antenna, a radio frequency signal receiving or transmitting stage constructed so as to operate at the operating frequency of the antenna.

24. A system adapted as a mobile telephone for receiving satellite signals with circular polarisation, adapted to receive, additionally, terrestrial telephone signals in a frequency band spaced from the frequency at which the satellite signals are received, comprising an antenna having an operating frequency in excess of 200 MHz, comprising a cylindrical insulative body having a central axis and formed of a solid material which has a relative dielectric constant greater than 5, the outer surface of the body defining a volume the major part of which is occupied by the solid material, a conductive sleeve on the cylindrical surface of the insulative body, a conductive layer on a surface of the body which extends transversely of the axis, the conductive sleeve and layer together forming an open-ended cavity substantially filled with the solid material and a feeder structure associated with the cavity, wherein the relative dielectric constant and the dimensions of the cavity are adapted such that the electrical length of its circumference at the open end is substantially equal to a whole number (1, 2, 3, . . . ) of guide wavelengths around the circumference corresponding to the operating frequency, wherein the antenna has a radiation pattern for circularly polarised radiation at the operating frequency, which pattern is cardioid-shaped with its maximum along the axis of the insulative body outwardly away from the open end of the cavity.

25. A radio signal receiving and/or transmitting system comprising a radio frequency front end stage constructed to operate at a first signal receiving or transmitting frequency and, coupled to the front end stage, an antenna which comprises:

a cylindrical insulative body having a central axis and formed of a solid material with a dielectric constant greater than 5, the outer surface of the body defining a volume the major part of which is occupied by the solid material, a conductive layer on a cylindrical surface of the body which extends transversely of the axis, a conductive sleeve on the cylindrical surface of the insulative body, the conductive sleeve and layer together forming an open-ended cavity substantially filled with the solid material, and a feeder structure associated with the cavity, wherein the relative dielectric constant and the dimensions of the cavity are adapted such that the electrical length of the rim of the cavity at its open ends is substantially equal to a whole number (1,2,3, . . . ) of guide wavelengths corresponding to the first signal frequency and wherein the antenna bas a radiation pattern for circularly polarised radiation at the operating frequency, which pattern is cardioid-shaped with its maximum along the axis of the insulative body outwardly away from the open end of the cavity.

26. The system according to claim 25, adapted to receive circularly polarised signals at the first signal frequency, wherein the feeder structure is arranged so as to promote a rotating standing wave around the rim of the cavity.

27. The system according to claim 25, wherein the feeder structure comprises a pair of axially co-extensive diametrically opposed helical elements each extending from a respective connection with a feed termination beyond the open end of the cavity to the rim of the cavity.

28. The system according to claim 27, wherein the feeder structure further comprises a coaxial transmission line passing through the core on the axis from a connection of its screen with the conductive layer to the feed termination, and wherein the cavity acts as a balun at the first signal frequency.

29. The system according to claim 25, wherein the radio frequency front end stage is adapted to operate additionally at a second receiving or transmitting frequency, and wherein the core has a portion which extends beyond the cavity opening in the direction of the axis and the feeder stature comprises a pair of elongate conductors on the surface of the core portion extending from the rim of the cavity to a feed termination, the conductors exhibiting a resonance for linearly polarised signals at the second signal frequency, and wherein the system further comprises a coupling stage having a common signal line associated with the antenna feeder structure and at least two further signal lines for connection to operate respectively at the first and second signal receiving frequencies.

30. The system according to claim 29, wherein the coupling stage comprises an impedance matching section and a signal directing section both connected between the feeder structure and the further signal lines, the signal directing section being arranged to couple together the common signal line on one of the further signal lines for signals at the first signal frequency, and to couple together the common signal line and the other further signal line for signals at the second signal frequency.

31. The system according to claim 30, wherein the pair of elongate conductors are formed as a twisted loop with the ends of the conductors lying substantially in a single plane containing the central axis whereby they have an associated radiation pattern at the second signal frequency which is omnidirectional with the exception of a null centred on a transverse null axis passing through the core.

32. The system according to claim 31, wherein the first signal frequency is substantially 1575 MHz or 1228 MHz, or in the range of from 1597 or 1617 MHz, or 1240 to 1260 MHz, or 1610 to 1626.5 MHz, or 2483.5 to 2500 MHz, or 1626.5 to 1646.5 MHz, or 1525 to 1545 MHz; and the second signal frequency is in the range of from 824 to 960 MHz, or 1710 to 1990 MHz.

33. A dielcrically-loaded cavity-backed antenna for circularly polarised waves at a required operating frequency in excess of 200 MHz, comprising a cavity with a conductive cylindrical side wall and a conductive bottom wall joined to the side wall, the side wall having a rim defining a cavity opening opposite the bottom wall, a dielectric core substantially filling the cavity and formed of a solid material having a relative dielectric constant greater than 5, and a rotational feed system, characterized in that the dielectric constant and the dimensions of the cavity are such that the circumference of the rim is substantially equal to a whole number (1, 2, 3 . . . ) of guide wavelengths at the required operating frequency, and wherein the feed system is adapted to excite a waveguide resonance in the cavity at the required operating frequency, which resonance is characterized by at least one voltage dipole oriented diametrically across the cavity opening and spinning about the central axis of the cavity thereby to produce a circular polarisation radiation pattern which is directed axially outwardly from the opening of the cavity and has a null in the opposite axial direction, wherein the antenna has a radiation pattern for circularly polarised radiation at the operating frequency, which pattern is cardioid-shaped with its maximum along an axis of the dielectric core outwardly away from the open end of the cavity.

34. A mobile telephone system operable in at least two spaced apart frequency bands, comprising an antenna, a coupling stage and a radio frequency stage, the radio frequency stage having at least two channels adapted to operate at frequencies within respective said bands, wherein:

the antenna comprises an antenna according to claim 33, the operating frequency of the antenna being a first operating frequency, the core of the antenna extends beyond the cavity opening, the feed system further comprises a pair of elongate conductors acting as a loop which exhibits a resonance for linearly polarised waves at a second operating frequency, the operating frequencies at which the resonances for circularly and linearly polaised waves occur being respectively within the spaced apart bands containing the operating frequencies of the channels, and the coupling stage has a common signal line connected to the feed system of the antenna and further signal lines for connection to respective inputs of the radio frequency stage, the inputs being associated respectively with the channels.

35. A method of operating an antenna which has a cylindrical insulative body made of a material with a dielectric constant greater than 5, a conductive sleeve on the cylindrical surface of the body, a conductive layer arranged on a transversely extending surface of the body so as to form, with the sleeve, an open-ended cavity substantially filled with the dielectric material, and a feeder structure associated with the cavity, wherein the method comprises feeding signals absorbed from the surroundings to a radio signal receiver unit, and/or radiating to the surrounding signals from a radio signal transmitter unit, at least one frequency at which a ring mode of resonance occurs around the sleeve at its open end, wherein the antenna has a radiation pattern for circularly polarised radiation at the operating frequency, which pattern is cardioid-shaped with its maximum along an axis of the insulative body outwardly away from the open end of the cavity.

36. The method according to claim 35, wherein the absorbed or radiated signals are circularly polarised.

* * * * *